US009566463B2

(12) United States Patent
Stout et al.

(10) Patent No.: US 9,566,463 B2
(45) **Date of Patent: *Feb. 14, 2017**

(54) AQUATIC EXERCISE DEVICE

(71) Applicant: Aqualogix, Inc., San Diego, CA (US)

(72) Inventors: Tadlington A. Stout, Santa Barbara, CA (US); James P. Cleary, San Diego, CA (US)

(73) Assignee: Aqualogix, Inc., Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/181,262

(22) Filed: Feb. 14, 2014

(65) Prior Publication Data

US 2014/0162851 A1 Jun. 12, 2014

Related U.S. Application Data

(60) Continuation of application No. 13/588,958, filed on Aug. 17, 2012, now Pat. No. 8,652,013, which is a continuation of application No. 12/559,420, filed on Sep. 14, 2009, now Pat. No. 8,246,523, which is a continuation of application No. 11/413,645, filed on Apr. 28, 2006, now Pat. No. 7,621,851, which is a division of application No. 10/688,453, filed on Oct. 18, 2003, now abandoned.

(60) Provisional application No. 60/419,604, filed on Oct. 18, 2002.

(51) Int. Cl.

| | |
|---|---|
| ***A63B 21/008*** | (2006.01) |
| ***A63B 21/00*** | (2006.01) |
| ***A63B 23/035*** | (2006.01) |

(52) U.S. Cl.

CPC ..... *A63B 21/0084* (2013.01); *A63B 21/0004* (2013.01); *A63B 21/00065* (2013.01); *A63B 21/4013* (2015.10); *A63B 21/4025* (2015.10); *A63B 23/03508* (2013.01)

(58) Field of Classification Search

USPC ..... 482/1–148

See application file for complete search history.

(56) References Cited

U.S. PATENT DOCUMENTS

| | | | | | |
|---|---|---|---|---|---|
| 3,109,186 | A | * | 11/1963 | Glenn | 441/60 |
| 3,142,485 | A | * | 7/1964 | Jacobsen | 482/55 |
| 3,424,133 | A | * | 1/1969 | Brady | 119/702 |
| 3,786,526 | A | * | 1/1974 | Ausseil | 441/59 |
| 4,411,422 | A | * | 10/1983 | Solloway | 482/111 |
| 4,416,451 | A | * | 11/1983 | Solloway | 482/111 |
| 4,565,369 | A | * | 1/1986 | Bedgood | 482/111 |
| 4,627,613 | A | * | 12/1986 | Solloway | A63B 21/0084 472/128 |
| 4,721,300 | A | * | 1/1988 | Guzman | 482/111 |

(Continued)

*Primary Examiner* — Stephen Crow

(74) *Attorney, Agent, or Firm* — Mintz Levin Cohn Ferris Glovsky and Popeo, P.C.

(57) ABSTRACT

An aquatic exercise device (100) includes a cuff strap (102) for fastening a plurality of fins (106) to a user's leg. The cuff strap (102) is configured to position the plurality of fins (102) to extend outwardly form an interior of the cuff strap (102) when the cuff strap (102) is fastened to an ankle area of the user's leg. The plurality of fins (106) provide resistance in a direction opposite to the direction of motion of the user's foot when the aquatic exercise device (100) is moved through water.

7 Claims, 6 Drawing Sheets

(56) References Cited

U.S. PATENT DOCUMENTS

| | | | | | |
|---|---|---|---|---|---|
| 5,002,275 | A * | 3/1991 | Beutler | A63B 69/3632 | 434/252 |
| 5,011,137 | A * | 4/1991 | Murphy | 482/55 | |
| 5,031,904 | A * | 7/1991 | Solloway | 482/111 | |
| 5,165,683 | A * | 11/1992 | Beutler | A63B 15/00 | 434/252 |
| 5,183,424 | A * | 2/1993 | Field | 441/64 | |
| 5,310,188 | A * | 5/1994 | Hernberg | A63B 69/3632 | 473/206 |
| 5,326,296 | A * | 7/1994 | De Jesus | 441/60 | |
| 5,415,406 | A * | 5/1995 | Reichenbach | A63B 69/3632 | 473/228 |
| 6,866,592 | B1 * | 3/2005 | Gitre | A63B 21/0088 | 473/206 |
| 7,090,618 | B2 * | 8/2006 | Stout | A63B 21/0084 | 482/55 |
| 7,118,490 | B2 * | 10/2006 | Namba | A63B 69/3632 | 473/226 |
| 7,458,900 | B1 * | 12/2008 | Park | A63B 21/0088 | 473/226 |
| 7,494,420 | B1 * | 2/2009 | Whalen | A63B 69/0002 | 473/228 |
| 7,621,851 | B2 * | 11/2009 | Stout et al. | 482/55 | |
| 8,790,224 | B1 * | 7/2014 | Davis | A63B 21/0084 | 441/50 |
| 8,998,740 | B2 * | 4/2015 | Corcoran | A63B 21/0088 | 473/228 |
| 2003/0207719 | A1 * | 11/2003 | Hughes | A63B 15/00 | 473/228 |
| 2004/0162167 | A1 * | 8/2004 | Stevens | A63B 21/0088 | 473/457 |
| 2007/0293334 | A1 * | 12/2007 | Osborne | A63B 69/3623 | 473/228 |

* cited by examiner

AQUATIC EXERCISE DEVICE

CROSS REFERENCE TO RELATED APPLICATIONS

This application is a continuation and claims the benefit of priority under 35 U.S.C. §120 of U.S. patent application Ser. No. 13/588,958, filed Aug. 17, 2012, titled "Aquatic Exercise Device," which is a continuation of U.S. patent application Ser. No. 12/559,420, now U.S. Pat. No. 8,246,523, filed Sep. 14, 2009, entitled, "AQUATIC EXERCISE DEVICE," which is a continuation of U.S. patent application Ser. No. 11/413,645, now U.S. Pat. No. 7,621,851, filed Apr. 28, 2006, entitled "AQUATIC EXERCISE DEVICE", which is a division application of Ser. No. 10/688,453, filed Oct. 18, 2003, entitled "AQUATIC EXERCISE DEVICE," which claims the benefit of U.S. Provisional Patent Application No. 60/419,604, filed Oct. 18, 2002; the disclosures of each of the aforementioned applications are hereby incorporated by reference in their entirety herein.

BACKGROUND

This document relates to exercise and physical therapy, and particularly to aquatic-based exercise and therapy.

Aquatic physical exercise has been found to be one of the best forms of exercise. Water supports an individual's body and alleviates most of the effects of gravity allowing the individual to exercise prescribed specific muscle groups without stressing other areas of the body. The reduced physical strain on these other area allows the individual to exercise for longer periods of time. The individual is also able to exercise longer due to a lower and more stabilized body temperature resulting from contact with the water. Strain on the heart, muscles and ligaments is minimized while the benefits of physical activity are maximized.

Accordingly, aquatics-based exercise is gaining in popularity, while aquatics-based physical therapy is becoming more preferred in the treatment of the elderly, the obese, and the infirm. There is a huge demand for an exercise modality which provides long-term health benefits and which can exist in the favorable environment of lower stress and freer movement. Conventional aquatic exercise devices and methods, however, are limited in several ways. For example, conventional devices do not offer uniform directional or rotational resistance when moved through the water. As a result, the devices feel awkward and unstable to the user. Further, conventional devices do not provide the appropriate resistance for exercises designed to develop muscles.

DETAILED DESCRIPTION

Figure 1:
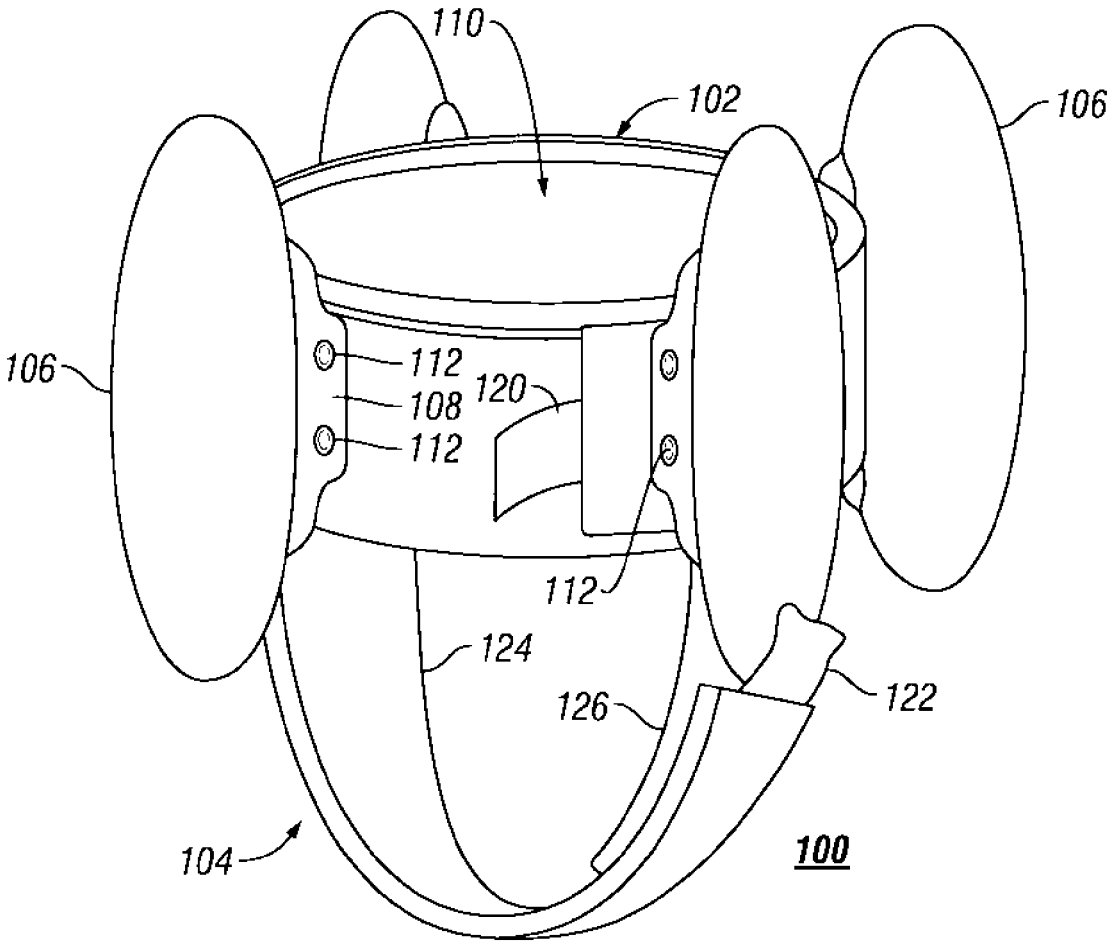
FIG. 1 is an illustration of a perspective view of an aquatic exercise device in accordance with the exemplary embodiment of the invention.
Figure 2:
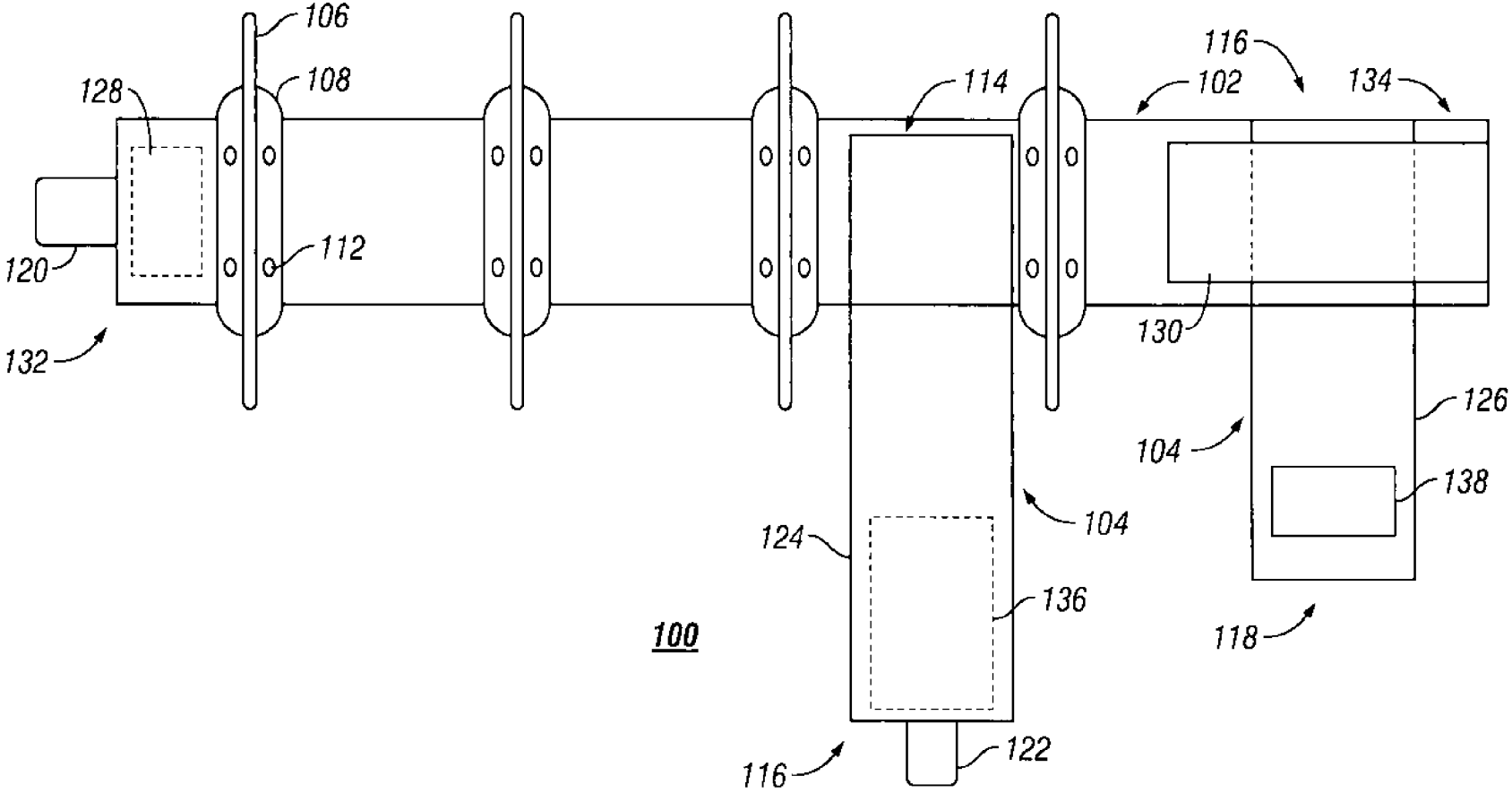
FIG. 2 is an illustration of a side view of the aquatic exercise device in an unfastened arrangement in accordance with the exemplary embodiment of the invention.

FIG. 1 shows a perspective view of an exemplary aquatic exercise device 100 in a fastened arrangement and FIG. 2 shows a side view of the exemplary aquatic exercise device 100 in an unfastened arrangement. The aquatic exercise device 100 provides substantially uniform directional resistance when moved through water by a user wearing the device 100 around the user's ankle area (not shown). The aquatic exercise device 100 includes a plurality of fins 106 attached to the user's foot or ankle by at least one fastening strap 102, 104. In the exemplary embodiment, the fastening straps include a cuff strap 102 configured to be wrapped around the ankle area of the user's leg and a stirrup strap 104 connected to the cuff strap 102 and configured to be wrapped around the bottom of the user's foot. The fastening straps 102, 104, therefore, form a strap assembly that allows the aquatic exercise device 100 to be fastened, attached, or otherwise worn by the user. Although the plurality of fins 106 may have any of numerous shapes and orientations, the fins 106 in the exemplary embodiment are attached to the cuff strap 102 in an orientation to position the fins 102 substantially parallel to the leg of the user when worn.

In the exemplary embodiment, the fastening straps 102, 104 are segments of a flexible material. The flexible material may include several layers of materials that are glued, sewn, or otherwise attached to each other. An example of a suitable arrangement of flexible materials includes a layer of neoprene attached to a resilient nylon layer such as a Dacron® material layer. Where the flexible material is elastic, a suitable fastening technique includes stretching the fastening straps 102, 104 to adapt the aquatic exercise device to fit various sized users. Where an inelastic material is used, a particular aquatic device 100 may fit a limited number of users. In some situations, the cuff strap 102 may be a continuous cuff formed from a flexible material allowing the user to insert the user's foot through the cuff to position the cuff strap 102 at the ankle of the user. In the exemplary embodiment, the cuff strap 102 includes two ends 132, 134 that are attached to each other by a cuff attachment when the cuff strap 102 is fastened to the user. The cuff attachment includes a first cuff attachment portion 128 and a second cuff attachment portion 130 that allow the ends 132, 134 of the cuff strap 102 to be secured in a relative position. In the exemplary embodiment, the cuff attachment includes a 'hook and loop' mechanism, such as a Velcro® attachment mechanism, where the first cuff attachment portion 128 includes the hook portion and the second cuff attachment portion 130 includes the loop portion. The cuff attachment is arranged on the cuff strap 102 such that first end 132 of the cuff strap 102 overlaps the second end 134 when the cuff strap 102 is attached to the user. The first cuff attachment portion 128, therefore, is drawn in FIG. 2 using dashed lines to illustrate that the first cuff attachment portion 128 is on the inside of the cuff strap 102. Examples of other suitable cuff attachments include clasps, belt buckles, and snaps.

Although the stirrup strap 104 may form a continuous stirrup extending from the cuff strap 102, the stirrup strap 104 in the exemplary embodiment includes a first stirrup section 124 and second stirrup section 126 that are attached to each other with a stirrup attachment when the aquatic exercise device 100 is fastened to the user. The stirrup attachment includes a first stirrup attachment portion 136 and a second stirrup attachment portion 138 that allow the first stirrup section 124 to be secured to the second stirrup section 126. In the exemplary embodiment, the stirrup attachment includes a 'hook and loop' mechanism, such as a Velcro® attachment mechanism, where the first stirrup attachment portion 136 includes the loop portion and the second stirrup attachment portion 138 includes the hook portion. The stirrup attachment is arranged on the stirrup strap 104 such that first stirrup section 124 overlaps the second stirrup section 128 when the stirrup strap 104 is attached to the user. The first stirrup attachment portion 136, therefore is drawn using dashed lines to illustrate that the stirrup attachment first portion 136 is on the inside of the first stirrup strap section 124. Examples of other suitable stirrup attachments include clasps, belt buckles, and snaps.

The stirrup strap 104 is attached to the cuff strap 102 by stitching an end 114 of the first stirrup strap section 124 to the cuff strap 102 and stitching an end 116 of the second stirrup section 128 to the cuff strap 102 in the exemplary embodiment. The two straps 102, 104, however, may be connected using any of numerous techniques and connection systems where some suitable examples include using rivets, snaps, buttons, and hook and loop fasteners.

In the exemplary embodiment, the cuff strap 102 includes a cuff tab 120 to aid the user in fastening the aquatic exercise device 100 by providing an easily gripped handle to allow the user to move the cuff strap 102 to desired position. A stirrup tab 122 facilitates the positing and fastening of the stirrup strap 104 in the exemplary embodiment. The tabs 120, 122, therefore, aid the user to move and position the fastening straps 102, 104 between the fastened and unfastened arrangements of the aquatic exercise device 100.

In the exemplary embodiment, the plurality of fins 106 extend outwardly in a direction perpendicular to a plane defined by the cuff strap 102 to position the fins 106 substantially parallel to the user's leg and extending outwardly from an interior 110 of the cuff strap 102. An example of a suitable shape of the plurality of fins 102 is a symmetrical elongated oval. In some circumstances, the fins 102 may have other shapes such as circles, squares, triangles or rectangles for example. The fins 106 are equally spaced along the cuff strap 102 such that, in the fastened arrangement, the fins 106 extend outwardly from a common central axis within the interior 110 and at equal radians to provide substantially uniform directional and rotational resistance. For example, where four fins 106 are used, the fins 106 extend out from the cuff strap 102 at substantially 90 degree increments in the fastened arrangement.

Any of numerous techniques or mechanisms can be used to directly or indirectly attach the fins 106 to the cuff strap 102. In the exemplary embodiment, a fin attachment mechanism 108 connects the fins 106 to the cuff strap 102. The fin attachment mechanism 108 is attached using rivets in the exemplary embodiment. Examples of other suitable techniques for attaching the fin attachment mechanism 108 to the cuff strap 102 include using screws, bolts, glue, staples and stitching. In some circumstances, one or more of the fins 106 may be releaseably attached using a fin attachment mechanism 108 that allows the fins 106 to be replaced. In such circumstances, various sized fins (106) can be used with a single fastening strap assembly. For example, a fin 106 of a first size or shape can be detached from the attachment mechanism 108 and a fin of a second size or shape can be attached or "snapped" to the fin attachment mechanism 108. The fins 106 may be any shape, and can be of different sizes to accommodate different levels of resistance based on a direction of movement. In the exemplary embodiment, the fins 106 are spaced roughly 1.5 inches apart, and are roughly 2.5 inches long and 1.5 inches wide. Vertically elongated fins 106 allow for greater freedom of movement and can lessen the potential for hitting or snagging against another aquatic exercise device 100 or other object, while providing a preferred surface area to provide resistance.

A suitable configuration of the aquatic exercise device includes a cuff strap 102 having width of approximately two (2) inches and a length of ten (10) inches that can accommodate a large range of foot and ankle sizes. In operation, the cuff strap 102 is wrapped around the ankle of a user as a cuff, and the stirrup strap 104 is wrapped under the foot of the user to inhibit vertical movement of the cuff strap 102. Either the cuff strap 102 or the stirrup strap 104 may be fastened first.

An exemplary method of exercising the user includes wrapping the cuff strap 102 around an ankle of the user, where the first strap 102 includes two or more outwardly-extending fins 106 preferably aligned in the direction of the person's leg. The method further includes wrapping two portions of the second strap 104 under the foot of the person and connecting the two portions. A second aquatic device 100 is fastened to the other foot. As the legs of the user are moved through the water, the fins 106 provide near-uniform resistance in the opposite direction to the direction of movement.

The aquatic exercise device 100 is ideal for stimulating the hip flexors, quadriceps and extensors when pushed forward. When the device 100 is pulled back, the hamstring, calves and gluteus muscle groups (often referred to as "glutes") are stimulated. When the aquatic exercise device 100 is moved in a side to side manner, the inside of the hips and thighs are stimulated, known as abduction and adduction. All movements can be performed in water and are useful for stretching and sports-specific movement, as well as rehabilitation for better health, weight loss, and wellness.

Figure 3:
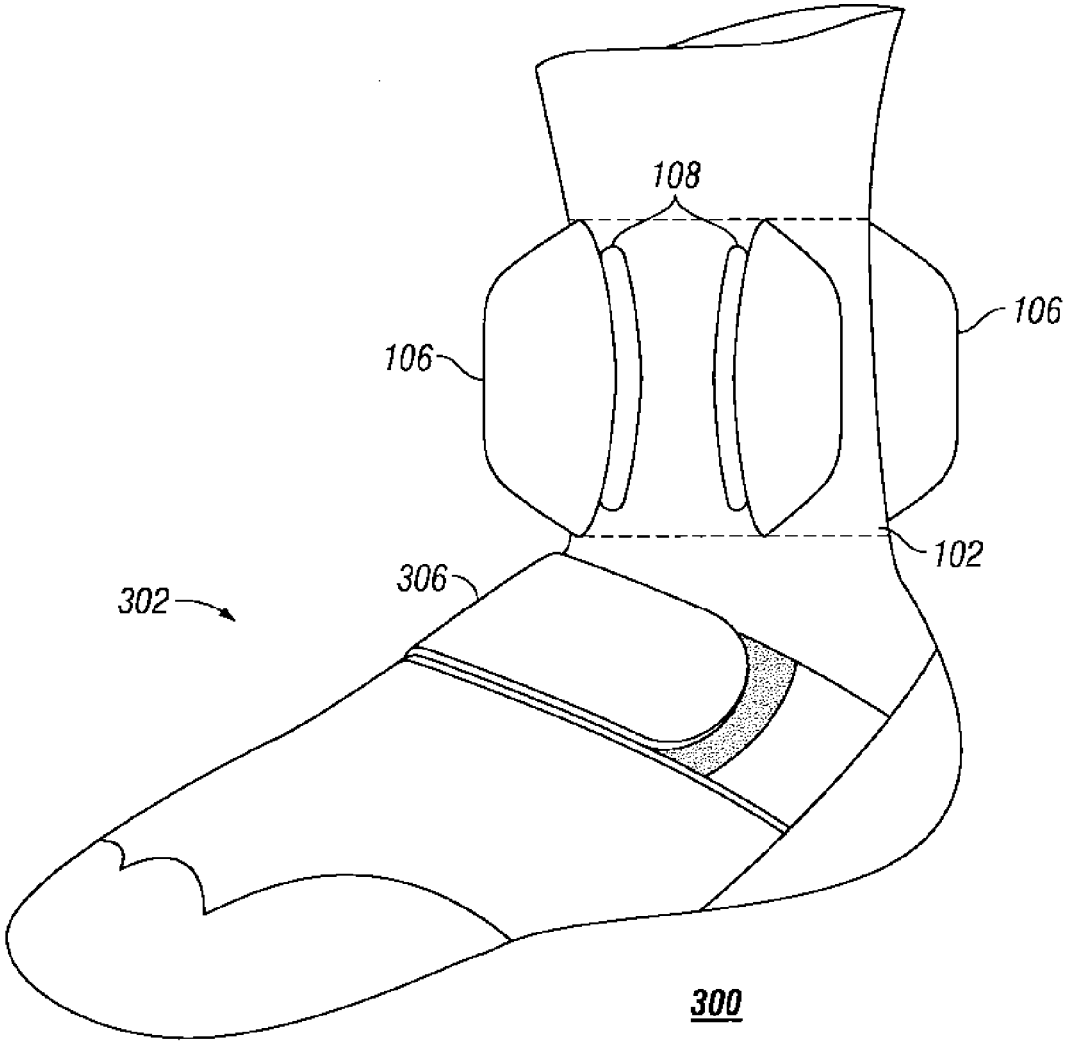
FIG. 3 is an illustration of a perspective view of a second exemplary aquatic device including a shoe.

FIG. 3 is an illustration of a perspective view of a second exemplary embodiment of the aquatic exercise device 300 where a shoe 302 forms the fastening strap assembly. The shoe 302 is formed using a waterproof boot, or "bootie", where the cuff strap 102 is disposed at or near a top of the shoe 302. In order to fasten the aquatic exercise device 300, the user inserts a foot through the opening formed within the inner portion 110 of the cuff strap 102 and pulls on the aquatic exercise device 300 in manner similar to the technique used to adorn a sock. The cuff strap 102 includes two or more fins 106 substantially as described above with reference to the first strap in FIGS. 1 and 2. The fins 106 can be attached directly to the shoe 302 at the cuff strap 102 or using a fin attachment mechanism 108.

The cuff strap 102 is formed of the same material as the shoe 302 so as to be contiguous with adjacent portions of the shoe 302 in the second exemplary embodiment. The cuff strap 102 may be a separate, adjustable part of the aquatic exercise device 300 in some circumstances and may be a strap that can be held by or connected to the shoe 302. For example, the cuff strap 102 may be formed of a strap that is threaded through loops provided on the outer surface of the shoe 302. Further, the cuff strap 102 may be sewn or glued to an outer surface of the shoe 302. Other means of attachment may be used in some situations.

The cuff strap 102 can be formed of an elastic material to accommodate various sizes of ankles and to conform to the ankle to prevent the shoe 302 from slipping off the user's foot. The shoe 302 is formed from neoprene in the second exemplary embodiment. The shoe 302 can be made of other materials such as rubber, nylon, Dacron®, or any combination thereof in some circumstances. The shoe 302 can also include one or more adjustable fasteners 306 to better conform the shoe 302 to a user's foot. The fasteners 306 can include hook and loop fasteners such, as Velcro® fastening mechanisms, or other fastening mechanisms. The fastener 306 may perform the function of a stirrup strap 104 in some circumstances.

Figure 4:
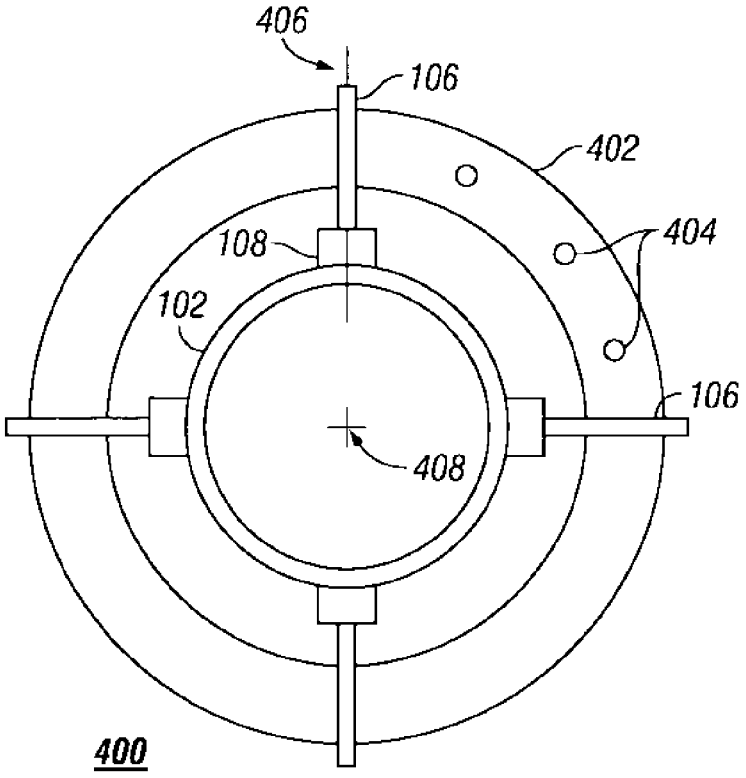
FIG. 4 is an illustration of a top-down view of an aquatic exercise device in accordance with a third exemplary embodiment of the invention from the perspective of a user standing upright and wearing the device in a fastened arrangement.

FIG. 4 is an illustration of a top-down view of an aquatic exercise device 400 in accordance with a third exemplary embodiment from a perspective of a user standing upright and wearing the aquatic exercise device 400 in a fastened arrangement. In addition to the plurality of fins 106 and the cuff strap 102 discussed with reference to the first and second exemplary embodiments, the aquatic exercise device 400 includes one or more latitudinal fins 402. In the third exemplary embodiment, the latitudinal fin 402 is a single latitudinal fin 402 constructed of flexible material such as neoprene or rubber. In some circumstances, the latitudinal fin 402 may be a single latitudinal fin 402 constructed of more rigid material such as plastic and may include one or more cuts. Such cuts may completely pass completely through the latitudinal fin 402 or may pass partially through making the latitudinal fin 402 sufficiently flexible to allow the user to insert the foot into the aquatic exercise device 400. Fins 106 may be coupled directly to the cuff strap 102 or may be attached using a fin attachment mechanism 108. The cuff strap 102 may be a continuous piece of material, as described with reference to FIG. 3, or may be formed from a strap that is wrapped and secured around the ankle area of a leg of a user as discussed in reference to FIG. 1 and FIG. 2.

In the third exemplary embodiment, the latitudinal fins 402 are planar and are connected at the approximately to the midpoint in a longitudinal axis 408 of the fins 106. The latitudinal fins 402, however, can be connected at any point to the longitudinal fins 106 and may have any suitable thickness. The latitudinal fin 402 may also extend outwardly from the interior 110 of the strap 102 out to the end of the longitudinal fins 106 or beyond. The latitudinal fins 402 provide additional resistance when, for example, the aquatic exercise device 400 is moved in an up-and-down movement in the longitudinal axis 408.

The latitudinal fin 402 is connected to the longitudinal fins 106 at substantially right angles in the third exemplary embodiment. In some circumstances, the latitudinal fin 402 is connected at an angle other than 90 degrees to provide resistance in a specific direction. The latitudinal fin 402 may also be releaseably connected to the fin attachment mechanisms 108. Such an arrangement may be useful where the latitudinal fin 402 is formed from a rigid material and can be mounted to the aquatic exercise device 400 after the user has inserted the foot. In the third exemplary embodiment, the latitudinal fin 402 includes a plurality of apertures 404 to allow the passage of water and to reduce resistance in the longitudinal axis 408. The number and size of the apertures 404 regulate the resistance in the longitudinal axis 408.

Figure 5:
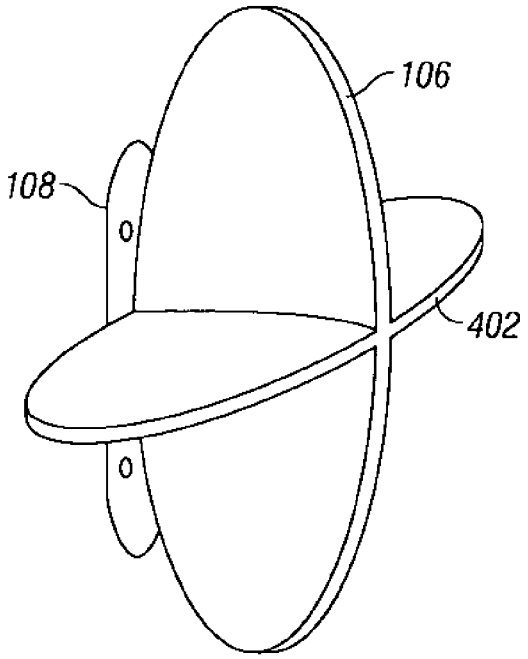
FIG. 5 is an illustration of a perspective view of a latitudinal fin attached to a longitudinal fin.

FIG. 5 is an illustration of a perspective view of a latitudinal fin 402 attached to a longitudinal fin 106 where a latitudinal fin 402 is attached to each of the plurality of fins 106. Each latitudinal fin 402 provides a resistance as described with reference to FIG. 4. By separating the single latitudinal fin 402 into a plurality of latitudinal fins 402, however, the latitudinal fins 402 may be constructed of rigid materials.

Figure 6:
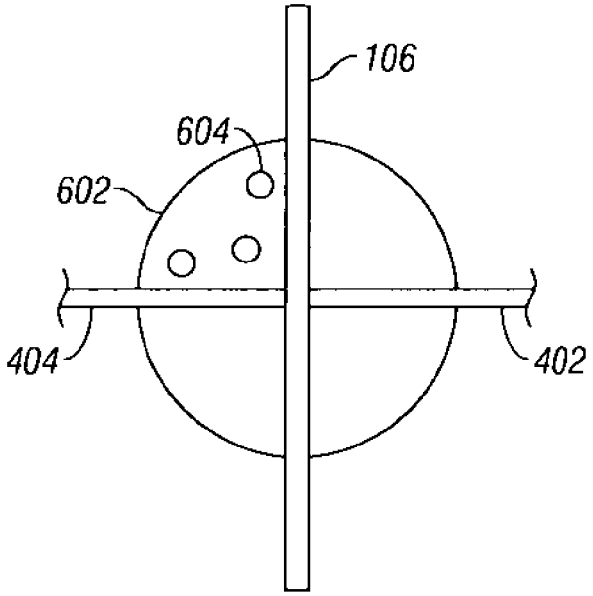
FIG. 6 is an illustration of a side view of a longitudinal fin in accordance with a fourth exemplary embodiment of the invention.

FIG. 6 is an illustration of a side view of one longitudinal fin 106 in accordance with a fourth exemplary embodiment of the invention. The longitudinal fin 106 is connected to latitudinal fin 402 as discussed with reference to the third exemplary embodiment and is also connected to a side plate 602 that provides added resistance in a sideward direction (i.e. the direction of least resistance for the particular vertical fin 106). In some circumstances, the side plate 602 includes one or more plate apertures 604. The size and number of apertures as well as the size and shape of the side plate 602 determines the added resistance in the direction of the longitudinal fin 106.

Figure 7:
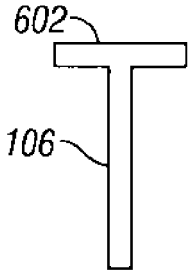
FIGS. 7-11 are illustrations of cross-sectional top views of several variations of the side plate attached to a fin.
Figure 8:
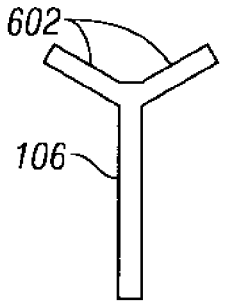
Figure 9:
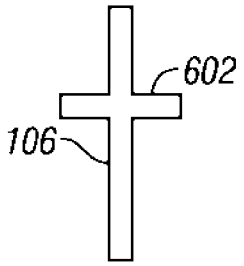
Figure 10:
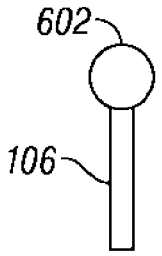
Figure 11:
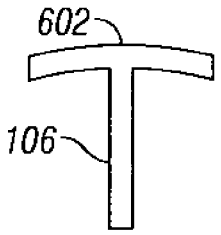

FIGS. 7-11 are illustrations of cross-sectional top views of several variations of the side plate 602 attached to a fin 106. FIG. 7 shows a "T"-shaped cross section of a fin 106 with side plate 602 coupled at a right angle at a distal end of the fin 106. The perpendicular a side plate 602 may have a rounded or squared surface area. FIG. 8 shows a "Y"-shaped cross section of a fin 600 with angled extending side plate. FIG. 9 shows a fin 106 having a perpendicular side plate 602 connected within the middle area of the fin 106. FIG. 10 shows cylindrically shaped side plate 602 coupled at a distal end of fin 106. FIG. 11 shows a curved side plate 602 coupled at a distal end of the fin 106. Those skilled in the art will readily apply the teachings herein in accordance with known techniques to modify the side plate shape, size, orientation and relative position. The curved side plate 602 referenced in FIG. 11, for example, may be coupled in the middle of the fin 106.

Figure 12:
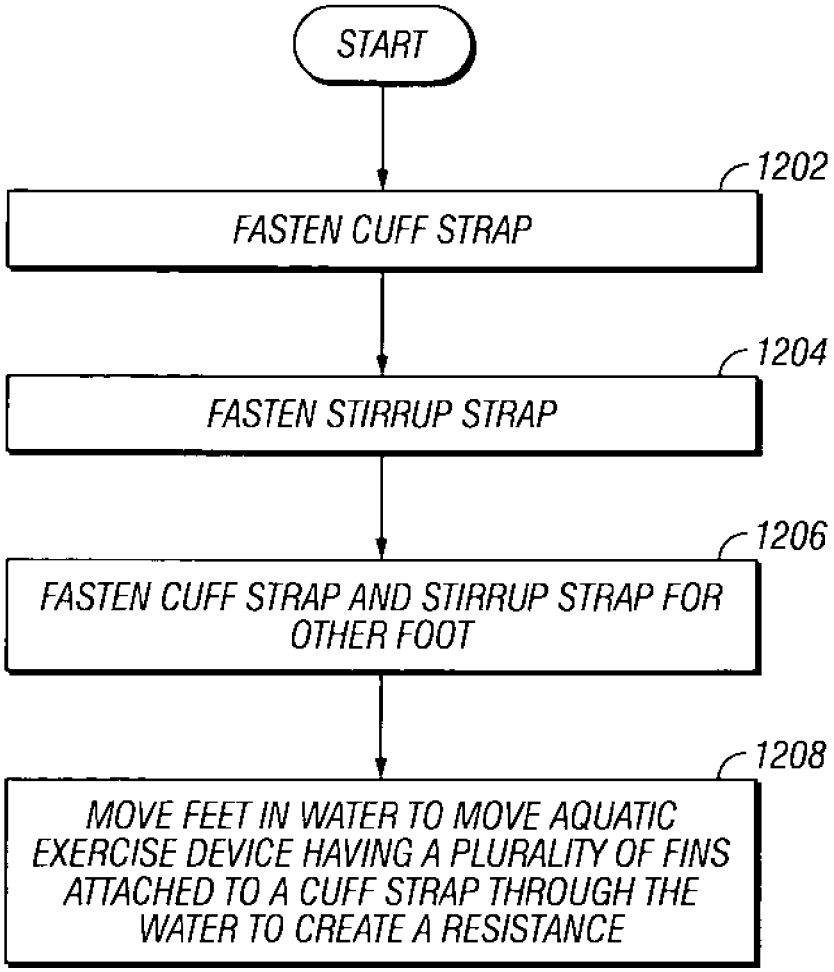
FIG. 12 is flow chart of an exemplary method of performing aquatic exercise using an aquatic exercise device.

FIG. 12 is a flow chart of an exemplary method of performing aquatic exercise using an aquatic exercise device 100. The method may be performed using any aquatic exercise device having a plurality of fins 106 attached to a cuff strap 102.

At step 1202, the cuff strap 102 of an aquatic exercise device 100 is fastened to an ankle area of leg of a user. In the exemplary method, the cuff strap 102 is snugly wrapped around the ankle area and fastened using the cuff attachment. Where the cuff attachment includes a hook and loop fastener, the loop portion is snuggly pushed against the hook portion to secure the cuff strap 102.

At step 1204, the stirrup strap 104 is fastened around the foot of the user. In the exemplary method, each section of the stirrup strap 104 is snugly wrapped under the user's foot and fastened to the opposite section using the stirrup attachment. Where the stirrup attachment includes a hook and loop fastener, the loop portion is snuggly pushed against the hook portion to secure the stirrup strap 104.

At step 1206, steps 1202 and 1206 are repeated for the user's other foot.

At step 1208, the user moves their feet in water to move the aquatic exercise device 100 through the water to create a resistance opposite to the direction of motion. Step 1208 is repeated as necessary to stimulate and break down muscle fiber for physical fitness or therapy. The movement may be performed by engaging in walking in a pool, executing swimming strokes, randomly moving the feet or kicking while sitting on the edge of pool or any other motion that creates a resistance and causes leg muscles to work.

Clearly, other embodiments and modifications of this invention will occur readily to those of ordinary skill in the art in view of these teachings. Therefore, this invention is to be limited only by following claims, which include all such embodiments, equivalents, and modifications when viewed in conjunction with the above specification and accompanying drawings.

What is claimed:

1. An aquatic exercise device comprising:

an elongated member;

a cuff that is configured to cuff around the elongated member;

at least three longitudinal fins connected to an outer surface of the cuff and spaced along the cuff and extending outwardly in a direction perpendicular to a plane defined by the cuff to position the longitudinal fins substantially parallel to an elongated member and extending outwardly from the cuff when the cuff is cuffed around the elongated member; and at least one latitudinal fin connected between at least one pair of the at least three longitudinal fins at a substantial midpoint of each longitudinal fin;

the equally spaced longitudinal fins and at least one latitudinal fin being spaced around the elongated member for providing omni-directional fluid resistance during motion of the elongated member through an aquatic environment when the cuff is provided around the elongated member.

2. An aquatic exercise device in accordance with claim 1, wherein the cuff includes a section of flexible material that encircles the elongated member to be moved through the aquatic environment by a user, the cuff further having a cuff attachment for releaseably attaching a first section of the flexible material to a second section of the flexible material.

3. An aquatic exercise device in accordance with claim 2, wherein the cuff attachment is a hook and loop mechanism.

4. An aquatic exercise device comprising:

a cuff that is configured to attach at least partially around an elongated member; and four longitudinal fins spaced apart along the cuff and extending outwardly in a direction perpendicular to a plane defined by the cuff to position the four longitudinal fins substantially parallel to an elongated member and extending outwardly from the cuff when the cuff is cuffed around the elongated member, the four longitudinal fins being spaced around the elongated member for providing substantially uniform fluid resistance in multiple directions during motion of the elongated member through an aquatic environment when the cuff is attached at least partially around the elongated member; and at least one latitudinal fin connected between at least one pair of the four longitudinal fins at a substantial midpoint of each longitudinal fin.

5. An aquatic exercise device in accordance with claim 4, wherein the cuff includes a section of flexible material that is encircles the elongated member to be moved through the aquatic environment by a user, the cuff further having a cuff attachment for releaseably attaching a first section of the flexible material to a second section of the flexible material.

6. An aquatic exercise device in accordance with claim 5, wherein the cuff attachment is a hook and loop mechanism.

7. An aquatic exercise device comprising:

a cuff for being provided around and engaging a substantially cylindrical portion of an elongated member;

at least three longitudinal fins spaced radially around the cuff and extending outwardly in a direction perpendicular to a plane defined by the cuff to position the at least three longitudinal fins substantially parallel to the elongated member and extending outwardly from the cuff when the cuff is cuffed around the elongated member, the at least three longitudinal fins being spaced around the elongated member for providing omni-directional fluid resistance during motion of the elongated member through an aquatic environment when the cuff is provided around the substantially cylindrical portion of the elongated member; and at least one latitudinal fin connected between at least one pair of the at least three longitudinal fins at a substantial midpoint of each longitudinal fin.

* * * * *